United States Patent [19]

Kaiser et al.

[11] Patent Number: 4,621,674

[45] Date of Patent: Nov. 11, 1986

[54] MEANS OF ANCHORAGE OF ANODE PINS OR STUBS IN A CARBON ANODE

[75] Inventors: Horst Kaiser, Inzlingen, Fed. Rep. of Germany; Ulrich Heinzmann, Zumikon, Switzerland; Alfred Sturm, Steinen-Hüsingen, Fed. Rep. of Germany

[73] Assignee: Swiss Aluminium Ltd., Chippis, Switzerland

[21] Appl. No.: 571,205

[22] Filed: Jan. 16, 1984

[30] Foreign Application Priority Data

Jan. 31, 1983 [CH] Switzerland ..... 534/83

[51] Int. Cl.[4] ..... B22D 19/04

[52] U.S. Cl. ..... 164/103; 164/111; 164/112

[58] Field of Search ..... 164/98, 99, 103, 105, 164/108, 110–112; 228/49 R, 122, 132, 134

[56] References Cited

U.S. PATENT DOCUMENTS

| | | | |
|---|---|---|---|
| 3,234,603 | 2/1966 | Leuthy et al. | 164/111 |
| 3,314,118 | 4/1967 | Stanworth | 164/112 |
| 3,807,012 | 4/1974 | Loqvist | 164/103 |
| 3,918,624 | 11/1975 | Kurihara | 164/112 |
| 4,112,574 | 9/1978 | Deli | 164/111 |
| 4,224,727 | 9/1980 | Miyashita | 164/111 |

FOREIGN PATENT DOCUMENTS

| | | | |
|---|---|---|---|
| 1937411 | 9/1971 | Fed. Rep. of Germany . | |
| 2628853 | 1/1978 | Fed. Rep. of Germany | 164/112 |

*Primary Examiner*—Nicholas P. Godici
*Assistant Examiner*—Richard K. Seidel
*Attorney, Agent, or Firm*—Robert H. Bachman

[57] ABSTRACT

The carbon anodes of aluminum reduction cells are suspended on anode rods. The lower part of these rods viz., the anode pins or stubs can be anchored in the carbon anode by pouring cast iron into suitably shaped anode pin or stub holes which are at least partially undercut at the sides.

A horizontal layer of cast iron at least some millimeters thick is formed between the floor of the pin or stub holes and the lower face of the anode pins or stubs.

The cast iron poured into the spaces around the anode pins or stubs heats these to over 400° C. The mass of the cast iron poured in is smaller than the mass of the lower part of the anode pin or stub to be enclosed.

6 Claims, 4 Drawing Figures

MEANS OF ANCHORAGE OF ANODE PINS OR STUBS IN A CARBON ANODE

BACKGROUND OF THE INVENTION

The invention relates to a means of anchorage of anode pins or stubs in a carbon anode for fused salt electrolytic cells for producing aluminum, comprising a casting which is attached to the lower part of the anode pin or stub and made up of cast iron which is cast in and solidified in at least partly undercut holes in the side of the anode pins or stubs.

In the electrolytic production of aluminum from aluminum oxide, the latter is dissolved in a fluoride melt consisting for the greater part of cryolite. The cathodically precipitated aluminum collects under the fluoride melt on the carbon floor of the cell, the surface of the liquid aluminum or a solid body which can be wet by aluminum forming the cathode. Dipping into the electrolyte from above and secured to an anode beam are anodes which in conventional reduction processes are made of amorphous carbon. As a result of the electrolytic decompositon of the aluminum oxide oxygen is formed at the anodes; this oxygen combines with the carbon of the anode to form $CO_2$ and CO. The carbon anodes must therefore be replaced by new anodes at periodic intervals.

The electrolytic process takes place in general in a temperature range of 940°–970° C.

The several hundred kilogram heavy prebaked carbon anodes are attached to the lower end of the anode rod i.e. the anode pins or stubs. Anode pins are round in cross section, anode stubs on the other hand quadratic or rectangular. For attachment to the anode rods, these are inserted in holes in the carbon block suitably shaped to accept the anode pins or stubs. The space surrounding these is filled with a rammed mass of carbon which can be baked to form a coke, or filled with cast iron. The material used for attaching these parts must exhibit not only high mechanical stability, but also good electrical conductivity at the contact faces.

As the carbon anodes employed represent a significant cost factor in the electrolytic production of aluminum, the depth of the holes for the anode pins or stubs is important. A spent anode must be changed before the naked iron pins or stubs come into contact with the molten electrolyte.

The German Pat. No. DE-PS 1 937 411 shows how the depth of the holes for the pins or stubs can amount to only 3–6 cm, in particular thanks to the use of undercutting of the holes.

Although Pat. No. DE-PS 1 937 411 results in a significant improvement with respect to depth of contact means and thus the amount of anode wastage, a further problem exists which cannot be adequately solved in accordance with this patent. On casting in the cast iron the anode rods stand on the bottom of the holes for the pins or stubs, they are surrounded and thus clad with cast iron in the lowest part. As the steel of the pins or stubs does not have the same coefficient of thermal expansion as the cast iron, on cooling, the cast iron which has the larger coefficient of expansion shrinks more than the steel. As a result, when the anode is put into service in the cell, there is a gap between the bottom of the hole for the pin or stub and the lower face of the pin or stub. This has the effect of causing most of the direct electric current to flow into the sides of the anode during the reduction process, and consequently a higher voltage drop results.

SUMMARY OF THE INVENTION

The object of the present invention is to develop a means of attaching anode pins or stubs in a carbon anode for fused salt electrolytic production of aluminum, which, during the electrolytic process, achieves improved contact between the bottom of the holes for the anode pins or stubs and the lower face of the pins or stubs, while at the same time having low contact resistance there.

This object is achieved by way of the invention in that a horizontal layer of cast iron, at least some millimeters thick, is provided between the bottom of the holes for the anode pins or stubs and the lower face of the anode pins or stubs.

BRIEF DESCRIPTION OF THE DRAWINGS

The invention is described in greater detail in the following with the help of exemplified embodiments shown schematically in the drawings viz.

DETAILED DESCRIPTION

Figure 1:
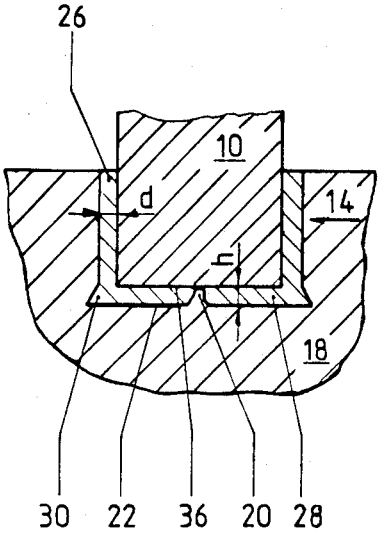
FIG. 1: A vertical cross-section through a means of anchorage featuring a projection in the carbon base.

It has been found advantageous for the thickness of the conventional side layer of cast iron and the thickness of the horizontal cast iron layer according to the invention to be approximately equal. Usefully, both the side layer and the horizontal layer are at least 5 mm thick, however, preferably 10–15 mm thick.

Further, it has been found useful for the floor of the holes for the pins or stubs to be dished and not flat as is normally the case.

The gap intended for the cast iron, between the bottom of the holes for the pins or stubs and the bottom face of the anode pins or stubs can be created for example by inserting the anode rod, then raising by the distance required for the gap and fixing at that height.

Preferably, however, the height of the horizontal gap, and thus the thickness of the cast iron layer, is achieved by mechanical means:

The carbon bottom of the holes for the pins or stubs features at least one projection which supports the inserted anode rod. These concave projections have a small base area.

The bottom face of the anode pins or stubs feature at least one projection or the like which is set on the bottom of the holes for the anode pins or stubs and thus forms the necessary gap to accommodate the horizontal layer of cast iron. Also, such projections have a small base area.

Before inserting the anode rod at least one piece of iron which determines the height of the horizontal gap is inserted in each hole for the anode pins or stubs. The anode rod is placed on top of this.

In order that the depth of the holes for the anode pins or stubs can be kept as small as possible, for example of the order of 5–10 cm, these holes are at least partly undercut. This is achieved by generally well known measures:

At least at the lower part of the holes the sidewalls taper inwards towards the top.

Horizontal grooves of any desired shape run partly or wholly round the walls of the holes. Usefully, these are not near the top edge of the holes as this would create the danger of fracture and pulling out of the pins or stubs.

In the case of anode pins at least three spiral grooves are provided; the slope of these is not less than 70°. As far as production and effectiveness of these is concerned a slope of 72°–75° is optimal, in particular if the corners of the grooves are rounded. With respect to the re-use of the cast iron not only is the geometric shape of the spiral grooves important but also the number of these; if there are more than six such grooves the cleaning of the cast iron piece becomes increasingly problematic.

In order to obtain reliable mounting of the anode pins or stubs in a carbon anode not only must the geometric conditions for the horizontal cast iron layer be considered, but, in particular, also the casting method. Under the normal cooling conditions for cast iron attachment using conventional casting the fixture would crack during cooling. If the anode pins or stubs are, as usual, pre-heated for example from 20° to 300° C., then after casting in the cast iron, shrinkage stresses arise which increase steadily with falling temperature.

With respect to the process the object according to the invention is achieved in that the bottom faces of the preheated anode pins or stubs are fixed at a distance from the bottom of the holes for the anode pins or stubs, and the cast iron cast into the surrounding space heats the anode pins or stubs to over 400° C., in this case the mass of cast-in cast iron being smaller than the mass of the lower part of the anode pins or stubs to be enclosed by the cast iron.

On heating the anode pins or stubs to over 400° C. the cast iron is for the greater part in the plastically formable state. Consequently on cooling to room temperature smaller shrinkage stresses are produced, and the cast iron does not crack.

Optimizing the method of casting showed that the combination of the following details leads to good results:

Pre-heating the anode pins or stubs to a temperature of 100°–300° C., preferably 150°–270° C.

Pouring temperature of 1200°–1350° C. for the cast iron, preferably around 1300° C.

A mass ratio of the amount of cast iron to that of the part of the anode pins or stubs to be surrounded to lie between 0.5:1 and 1:1.

The region of the holes for the pins or stubs in the carbon anode to be pre-heated to 80° to 200° C., preferably about 100° C.

The cast iron is filled in up to the uppermost side of the carbon anode.

By providing at least partly undercut recesses in the sidewalls of the holes for the anode pins or stubs abutments for the cast iron are created. Thus, after re-heating in the cell, the bottom faces of the anode pins or stubs are constantly pressed against the solidified horizontal cast iron layer so that as a result a smaller contact resistance is assured. The current then flows mainly in the vertical direction through the anode pins or stubs into the anodes.

Trials have shown that, on using the conventional process for casting in the anode rods, the contact resistance lies between 50 and 60 uΩ after 6 days in service. Using the anode rods cast in according to the invention on the other hand the contact resistance after 4 days in service lies only at 25–30 uΩ. Consequently the total resistance of the electrolytic cell for producing aluminum can be substantially lowered, which in turn results in lower energy costs.

FIG. 1 shows a means of anchoring an anode pin 10 in a correspondingly shaped hole 14 in the carbon anode 18, whereby the anode pin 10 is first placed on the essentially blunted cone-shaped projection 20 on the floor 22 of the hole 14. The casing comprises a mantle 26 of cast iron and a horizontal layer 28 also of cast iron, the thickness d of the mantle being approximately the same as the thickness h of the horizontal layer.

The anchorage of the cast iron in the carbon anode is effected by an undercut, wedge-shaped groove 30 which runs round the base 22 of the hole 14.

Figure 2:
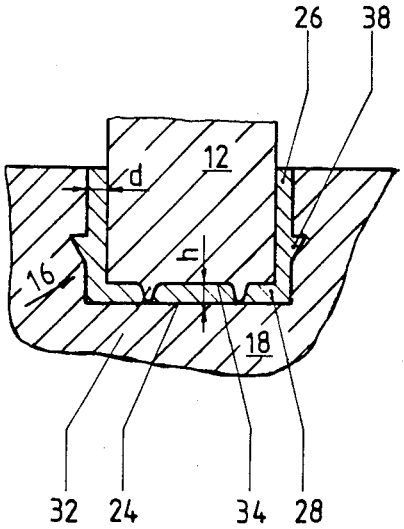
FIG. 2: A vertical cross-section through a means of anchorage featuring projections on the bottom face of the anode pin.

FIG. 2 shows the anchorage of a rectangular anode stub 12 in a correspondingly shaped hole 16. The gap foreseen for the horizontal layer of cast iron of thickness h is created by the provision of projections 32 on the lower face 34 of stub 12 which rests on the floor 24.

To anchor the cast iron layer in the carbon anode 18 an abutment 38 in which some of the cast iron solidifies is provided in the middle to lower region of the hole 16.

Figure 3:
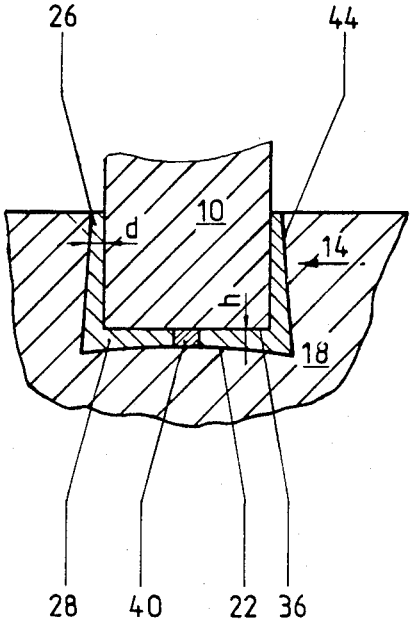
FIG. 3: A vertical section through a means of anchorage featuring an inserted piece of iron.

In the means of anchorage of an anode pin according to FIG. 3 the floor 22 of the hole 14 is slightly concave. The bottom face 36 of pin 10 rests on a piece of iron 40 and as a result after pouring in the cast iron creates a horizontal cast iron layer of thickness d. The sidewall 44 of the hole 14 is tapered inwards from the bottom to the top and thus ensures anchorage of the cast iron mantle 26 in the carbon anode 14.

Figure 4:
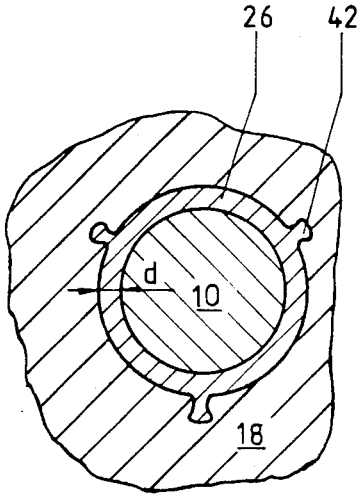
FIG. 4: A horizontal cross-section through a means of anchorage featuring spiral grooves which act as undercut abutments in the hole for the anode pin.

FIG. 4 shows a means of anchorage of an anode pin 10 where three spiral grooves 42 provide an abutment at the side. The grooves are essentially dove-tailed in cross-section, but with strongly rounded corners.

With all the versions according to the invention the first application of the described method requires slightly more cast iron than do the conventional methods. The bond between the cast iron and the anode pin or stub is sufficiently strong during the electrolytic process but can be broken using a stripping device. The cast iron, which can be cleaned before or after stripping, is then melted down for re-use.

What is claimed is:

1. Process for anchoring anode pins or stubs in carbon anodes for fused salt electrolytic cells which comprises forming a hole in said carbon anode to receive said anode pin or stub having floor and wall portions thereof, pre-heating said anode pin, placing said anode pin in said hole spaced from said floor and wall portions, pouring cast iron into said space whereby the cast iron heats the anode pin to over 400° C., wherein the mass of cast iron poured in is smaller than the mass of the lower part of the anode pin or stub to be enclosed and wherein the ratio of the mass of cast iron to the mass of the lower part of the anode pin or stub to be enclosed lies between 0.5:1 and 1:1.

2. Process according to claim 1 wherein the anode pins are pre-heated to 100°–300° C.

3. Process according to claim 1 wherein the pouring temperature of the cast iron is 1200°–1350° C.

4. Process according to claim 1 wherein said hole is pre-heated to 80° to 200° C.

5. Process according to claim 1 wherein the anode pin is pre-heated to 150°–270° C., the pouring temperature of the cast iron is about 1300° C. and the region of the holes is pre-heated to about 100° C.

6. Process according to claim 1 wherein said hole includes at least partially undercut portions thereof.

* * * * *